United States Patent [19]

Crookston et al.

[11] Patent Number: 4,686,337

[45] Date of Patent: Aug. 11, 1987

[54] CIRCUIT INTERRUPTER HAVING A CHEMICAL OPERATOR WITH DOUBLE-ACTING DRIVE MEANS

[75] Inventors: Ronald W. Crookston, Trafford; Ivan T. Burney, Pittsburgh, both of Pa.

[73] Assignee: Westinghouse Electric Corp., Pittsburgh, Pa.

[21] Appl. No.: 761,452

[22] Filed: Aug. 1, 1985

[51] Int. Cl.[4] ..... H01H 33/42

[52] U.S. Cl. ..... 200/148 F; 200/82 B

[58] Field of Search ..... 200/148 F, 82 B, 150 R, 200/148 R

[56] References Cited

U.S. PATENT DOCUMENTS

| | | | |
|---|---|---|---|
| 2,477,788 | 8/1949 | Cumming | 200/150 R |
| 4,131,774 | 12/1978 | Crookston et al. | 200/148 B |
| 4,271,341 | 6/1981 | Meyer | 200/82 B |
| 4,438,306 | 3/1984 | Crookston et al. | 200/148 F |
| 4,580,020 | 4/1986 | Norikane | 200/148 F |

FOREIGN PATENT DOCUMENTS

| | | | |
|---|---|---|---|
| 956861 | 1/1957 | Fed. Rep. of Germany | 200/82 B |
| 1540539 | 1/1970 | Fed. Rep. of Germany | 200/82 B |

*Primary Examiner*—Robert S. Macon
*Attorney, Agent, or Firm*—L. P. Johns

[57] ABSTRACT

A double-acting chemical operator drive assembly having a pair of pistons that are secured to the ends of a single piston rod and cooperate with a pair of power cylinders provide a positive drive for opening and closing the separable contacts of a circuit interrupter when the pistons are sequentially actuated by high-pressure gas generated by chemical propellant charges. The power cylinders are spaced apart and aligned with one another and the piston rod extends through open ends of the power cylinders. This eliminates the need for shaft seals and simplifies the manufacture and maintenance of the drive assembly. The operator drive assembly is coupled to the operating mechanism of the circuit interrupter by a yoke that is secured to an exposed medial part of the piston rod and then to a tie bar by a pair of drive rods.

5 Claims, 2 Drawing Figures

CIRCUIT INTERRUPTER HAVING A CHEMICAL OPERATOR WITH DOUBLE-ACTING DRIVE MEANS

BACKGROUND OF THE INVENTION

1. Field of the Invention:

This invention generally relates to circuit interrupter apparatus and, more particularly, to an operating mechanism for such apparatus having an improved chemical operator drive mechanism of the double-action type.

2. Description of the Prior Art:

Certain types of circuit interrupters are provided with operating drive mechanisms that employ a chemical operator drive means comprising a gas generator of the chemical propellant type which ignites a propellant charge of gas-generating material and directs a high pressure gaseous medium into a drive piston and power cylinder assembly. The piston is coupled by suitable linkage means to the movable contact of the interrupter and the operating mechanism and is adapted to open and close the contacts in a rapid and positive manner when the propellant charges are ignited.

Circuit interrupter apparatus having a chemical operator drive means arranged to close the interrupter contacts is disclosed in U.S. Pat. No. 4,131,774 issued Dec. 26, 1978 to Crookston et al. A circuit breaker having a gas-propellant type operating means for quickly opening the breaker contacts and utilizing spring means for returning the actuating piston to its closed-contact position is disclosed in U.S. Pat. No. 4,271,341 issued June 2, 1981 to Meyer.

While the prior art chemical operator drive systems provide the desired quick-response actuation of the circuit breaker operating mechanism and contacts, they employ piston rods that are sealed to the cylinder of the operator assembly. These seals not only added to the cost of the circuit breaker but constitute a maintenance problem insofar as the combustion of the propellant inherently produces residues which are deposited on the piston drive rod with resultant "gumming" of the shaft seal and progressive abrasion of both the piston seal and shaft. It would accordingly be desirable from both a cost and reliability standpoint to eliminate the need for shaft seals in chemical operator drive mechanisms without detracting from the quick-response and positive-acting characteristics of the drive mechanisms.

SUMMARY OF THE INVENTION

The foregoing objectives and other advantages are achieved in accordance with the present invention by constructing the power cylinder of the chemical operating assembly in such a manner that the high-pressure gaseous medium is contained within the piston chamber solely by piston rings and the piston rod extends through an open end of the cylinder. The rod is terminated by a second piston that is housed within another open-ended power cylinder so that the drive rod is reciprocally movable in response to the sequential propulsion of the pistons by the pressurized gas generated by the chemical propellant charges. The exposed medial part of the single drive piston rod is mechanically coupled to the operating mechanism of the circuit breaker and each of the power cylinders is connected to a reloader component that contains a suitable chemical gas-generating charge. Ignition of the chemical charges in the proper sequence accordingly propels the piston rod in one direction and then in the opposite direction with resultant opening and closing of the breaker contacts.

The invention accordingly provides a double-acting chemical operator that requires a minimum number of parts and eliminates the need for shaft seals, thus avoiding the maintenance problems encountered with prior art chemical operators having such seals.

BRIEF DESCRIPTION OF THE DRAWING

A better understanding of the invention will be obtained from the exemplary embodiment shown in the accompanying drawing, wherein.

DESCRIPTION OF THE PREFERRED EMBODIMENT

Figure 1:
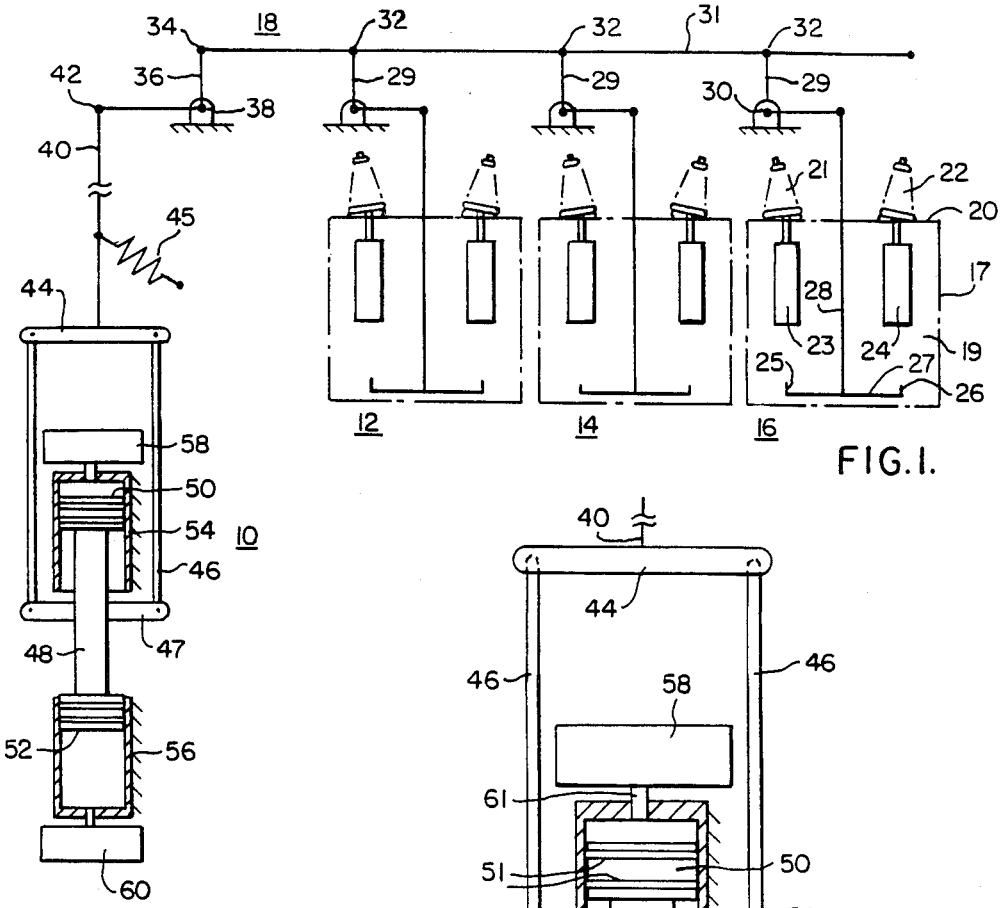
FIG. 1 is a diagrammatic elevational view, partly in section, of a three-phase oil power circuit breaker, operating mechanism and chemically-actuated drive means constructed in accordance with the teachings of the invention.

Referring now to the drawing in detail, the improved chemical operator drive mechanism 10 of the present invention is illustrated in FIG. 1 in operative relationship with a plurality of circuit interrupters 12, 14, 16 of conventional design such as an oil-break, air-break or gas-blast type. A suitable operating means 18 extends between the drive mechanism 10 and the circuit interrupters 12, 14, 16. Since each of the circuit interrupters are identical only interrupter 16 will be described in detail. As will be noted, circuit interrupter 16 comprises a tank 17 that contains a suitable arc-extinguishing fluid 19 and is closed by a cover 20 that supports two terminal bushings 21, 22. A pair of spaced stationary contacts 23, 24 are provided at the inner ends of the terminal bushings 21, 22 and cooperate with movable contacts 25, 26 that are mounted on a bridging contact member 27 secured to the lower end of an insulated operating rod 28 to open and close the contacts of the interrupter 16 in the well known manner. A more detailed description of the construction and operation of a circuit breaker of this type is given in U.S. Pat. No. 2,477,788 which is incorporated herein by reference.

The upper end of each operating rod 28 is pivotally secured to suitable lever means, such as a bell crank 29, which is movable about a stationary pivot 30. An elongated link 31 is pivoted at 32 to each of the bell cranks 29 and its opposite end is pivoted at 34 to another bell crank 36 which, in turn, is movable about another stationary pivot 38. Another link 40 which is pivoted at 42 and coupled to the other end of the bell crank 36 constitutes a vertical pull rod that is connected to the drive mechanism 10 by a tie bar 44, a pair of drive rods 46 and a connecting link or yoke 47 that is secured to the piston rod 48 of the drive mechanism. A biasing spring 45 is coupled to the pull rod link 40 and is compressed to apply a load on the operating mechanism 18 which maintains the circuit breakers 12, 14, 16 in their open or closed positions.

The operating mechanism 18 accordingly comprises the several parts 28, 29, 31, 36, and 40 which coact with one another in the well known manner to open the separable contact pairs 23, 25 and 24, 26 when the operating mechanism 18 is actuated by the chemical operator drive mechanism 10.

Figure 2:
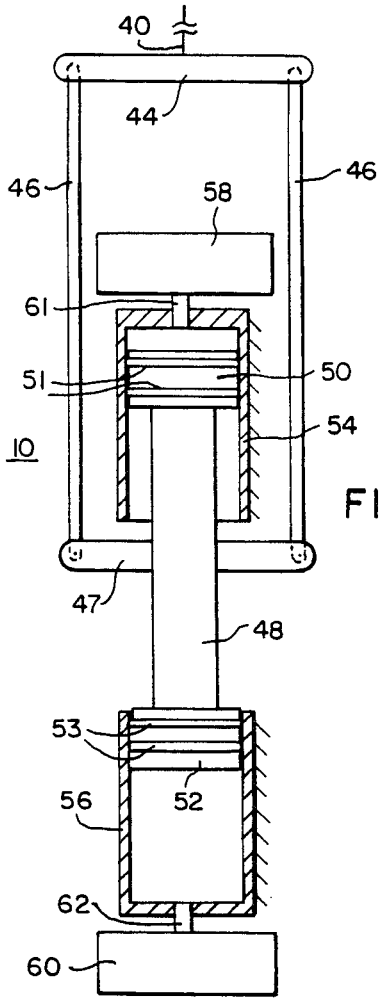
FIG. 2 is an enlarged elevational view, partly in section, of the improved double-acting chemical operator mechanism shown in FIG. 1.

The construction of the chemical operator drive mechanism 10 is more clearly shown in FIG. 2 and will now be described. As will be noted, the connecting yoke 47 is secured to and extends laterally from the medial exposed part of the piston rod 48 that is terminated at each end by pistons 50, 52 which are reciprocally movable spaced-apart stationary power cylinders 54, 56. Each of the cylinders 54, 56 is provided with a chemical reloader component 58, 60 that communicates with the respective piston-cylinder chambers through suitable conduits 61, 62 that extend through the end walls of the cylinders. The chemical reloaders 58, 60 are adapted to receive ignitable charges of a suitable propellant such as a smokeless gun powder that is capable of generating a gas pressure of from about 3,000 to 10,000 psi (or higher) when ignited. Ignition of the propellant charges generates a gaseous medium that expands at high pressure into the chambers of the respective power cylinders 54, 56 and drives the pistons 50, 52 in reciprocal fashion, thus either opening or closing the separable contacts 23, 25 and 24, 26 of the circuit breakers 12, 14, 16 depending upon which of the reloaders 58, 60 is fired and which of the pistons 50, 52 is driven by the expanding gas.

Containment of the generated gaseous medium within the power cylinders 54, 56 is achieved solely by means of a pair of piston rings 51, 53 on the respective pistons 50, 52. The rings 51, 53 make a tight compression fit with the surrounding cylinder walls and thus provide the gas-tight seals that are requried to permit the drive assembly 10 to operate in a positive reliable manner when the propellant charges are fired. The piston rod 48, on the other hand, extends through the open ends of the power cylinders 54, 56 and this construction thus eliminates the conventional shaft seals heretofore employed in the prior art chemical operator drive mechanisms. While a pair of piston rings 51, 53 have been shown on each of the pistons 50, 52, only one such ring per piston can be employed (if it is properly designed and constructed) or a series of rings (six for example) can be used on each piston, depending upon the type of propellant charge which is used and the gas pressures which are generated.

As will be noted, the power cylinders 54, 56 are arranged in spaced substantial longitudinal alignment with their open ends facing one another so that the piston rod 48 is substantially straight and movable in straight-line reciprocal fashion. The connecting yoke 47 extends laterally beyond the piston rod 48 and the drive rods 46 extend longitudinally along opposite sides of the rod 48, the power cylinder 54 and its associated chemical reloader component 58 to the laterally-extending tie bar 44.

The improved chemically-actuated drive mechanism 10 of the present invention thus provides a double-acting motivating means for rapidly opening and closing the separable contacts of the circuit interrupters 12, 14 and 16 in a positive reliable manner with minimum cost and maintenance.

The motive power provided by the dual-acting chemical operator drive mechanism 10 of the present invention can be readily modified and controlled by utilizing power cylinders and pistons of different diameters instead of cylinders and pistons that have the same diameter as in the illustrated embodiment. A single power cylinder and piston combination can also be used if a suitable valve means is provided in the cylinder structure to control the flow of the generated-pressurized gas into the piston chamber.

The chemical operator drive mechanism 10 can also include means for automatically introducing new propellant charges into the reloaders 58, 60 so that a predetermined number of contact-opening and contact-closing operations can be performed.

We claim:

1. An electric circuit interrupter comprising;

a pair of separable contacts, operating means for opening and closing said contacts, drive means for actuating the operating means and comprising a pair of open-ended spaced-apart stationary cylinders and a single piston rod that is reciprocally movable and extends into the open ends of said cylinders so that a medial part of said piston rod is disposed in the space between the cylinders and is thereby exposed, said piston rod having a piston at each end that is operatively disposed within the respective stationary cylinders and provided with means that forms a seal with the associated cylinder wall, generating means for controllably producing and sequentially injecting a pressurized gaseous medium into said cylinders and thereby driving the associated pistons and piston rod in a first direction and then in the oppposite direction, and means coupling the exposed medial part of the piston rod to the operating means in a manner such that the reciprocal movement of the piston rod actuates the operating means to open and close the contacts of the circuit interrupter at predetermined times, said coupling means including a yoke that is secured to and extends laterally beyond the exposed medial part of the piston rod.

2. The electric circuit interrupter of claim 1 wherein said laterally extending yoke is fastened to a pair of longitudinally extending drive rods that are disposed on opposite sides of the piston rod and one of the cylinders and are secured to a tie bar that is remote from said cylinders and coupled to said operating means.

3. The electric circuit interrupter of claim 2 wherein said cylinders are disposed in substantially longitudinal alignment with the open ends thereof proximate one another, and said piston rod is substantially straight.

4. The electric circuit interrupter of claim 1 wherein said seal means comprises from one to six piston rings that are carried by each of the pistons and are in seal-forming relationship with the associated cylinder walls.

5. The electric circuit interrupter of claim 1 wherein the pressurized gaseous medium is generated by a chemical propellant that is disposed within a reloader component secured to the respective drive cylinders, each of said reloader components being in communication with the chambers that are formed by said cylinders and the associated pistons.

* * * * *